US005161565A

United States Patent [19]

Jamieson

[11] Patent Number: 5,161,565

[45] Date of Patent: Nov. 10, 1992

[54] COVER AND RETAINER FOR A COMPRESSOR VALVE

[75] Inventor: Richard A. Jamieson, Horseheads, N.Y.

[73] Assignee: Dresser-Rand Company, Corning, N.Y.

[21] Appl. No.: 807,926

[22] Filed: Dec. 16, 1991

[51] Int. Cl.[5] ..... F16K 27/12

[52] U.S. Cl. ..... 137/315; 137/454.4; 137/454.6

[58] Field of Search ..... 137/454.4, 454.6, 315, 137/543.19; 251/367; 220/327

[56] References Cited

U.S. PATENT DOCUMENTS

| | | | |
|---|---|---|---|
| 1,100,095 | 6/1914 | Prescott | 220/327 X |
| 1,660,193 | 2/1928 | Halleck | 137/454.4 |
| 1,738,403 | 12/1929 | Steedman | 137/454.4 |
| 2,297,942 | 10/1942 | Collins | 137/454.6 X |
| 2,304,991 | 12/1942 | Foster | 137/454.4 |
| 4,253,583 | 3/1981 | Lynch | 220/327 X |
| 4,465,201 | 8/1984 | Chalfant | 220/327 X |
| 4,532,955 | 8/1985 | Squires | 220/327 X |

FOREIGN PATENT DOCUMENTS

| | | | |
|---|---|---|---|
| 6008 | of 1905 | United Kingdom | 251/367 |

*Primary Examiner*—Stephen M. Hepperle
*Attorney, Agent, or Firm*—Bernard J. Murphy

[57] ABSTRACT

The domed, cast metal retainer, having a bolting flange and a depending annulus for engaging the valve or valve crab, in a gas compressor is supplanted by the invention. The latter comprises a simple, flat plate and a cylindrical plug. The plug is set into the housing shell of the compressor to engage and secure the valve or valve crab, and the plate is bolted to the housing shell, upon the plug, to retain it and the valve or valve crab in position. The plate and plug are formed from common raw stock.

10 Claims, 1 Drawing Sheet

COVER AND RETAINER FOR A COMPRESSOR VALVE

This invention pertains to fluid valves, for compressor cylinders, which are set in compressor housing shells, and in particular to covers and retainers therefor.

In the prior art, it is typical to employ domed and cast valve covers for valves in compressor housing shells. These known covers have depending annuluses which contactingly engage the valve, to hold the latter in place in the housing shell, and outwardly-extending flanges for bolting thereof to the housing shell.

It is desirable to be able to provide a cover and retainer for such compressor valves which can be formed from standard, raw materials, rather than having to employ the especially configured, cast valve covers.

It is an object of this invention to set forth just such a cover and retainer, for a compressor valve, which is simply fabricated from standard stock or raw materials.

Particularly it is an object of this invention to set forth a cover and retainer, for a compressor valve in a compressor shell, comprising a plug, for (a) insertion into the shell and (b) engagement with the valve; and a cover, for overlying the plug and holding the plug in place.

It is also an object of this invention to disclose, in a compressor housing shell which has a valve set therein, a cover and retainer for the valve, comprising a plug, within the housing shell and in engagement with the valve; and a cover, overlying said plug and holding said plug in said housing shell.

Figure 1:
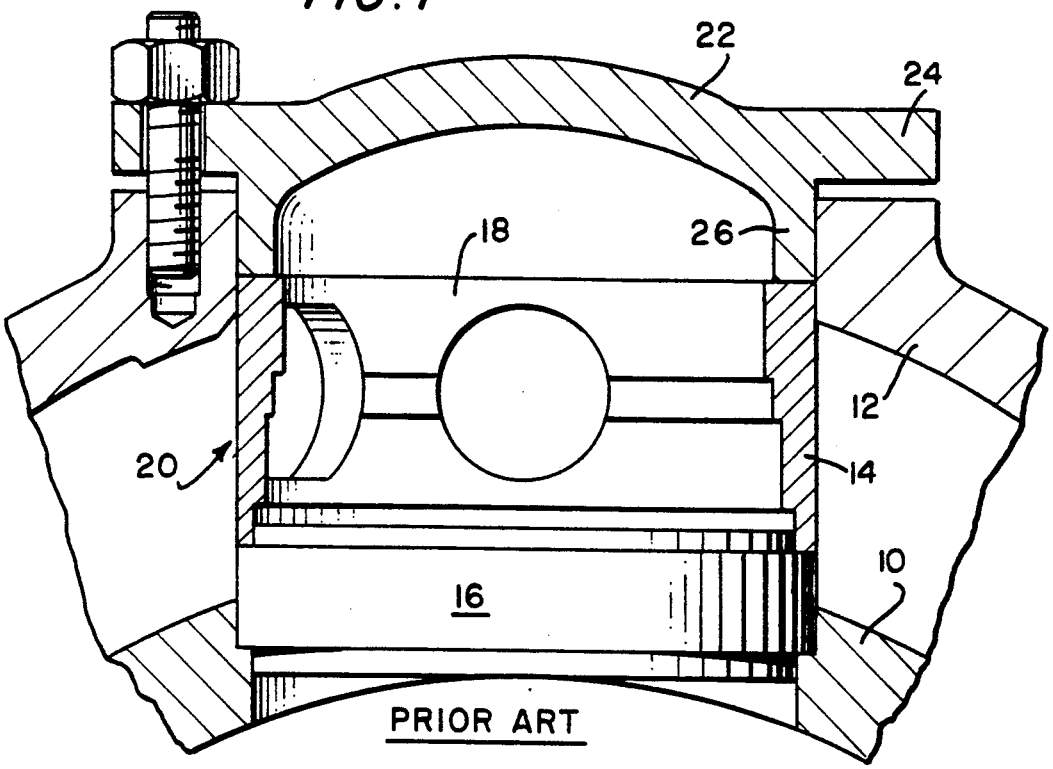
Figure 2:
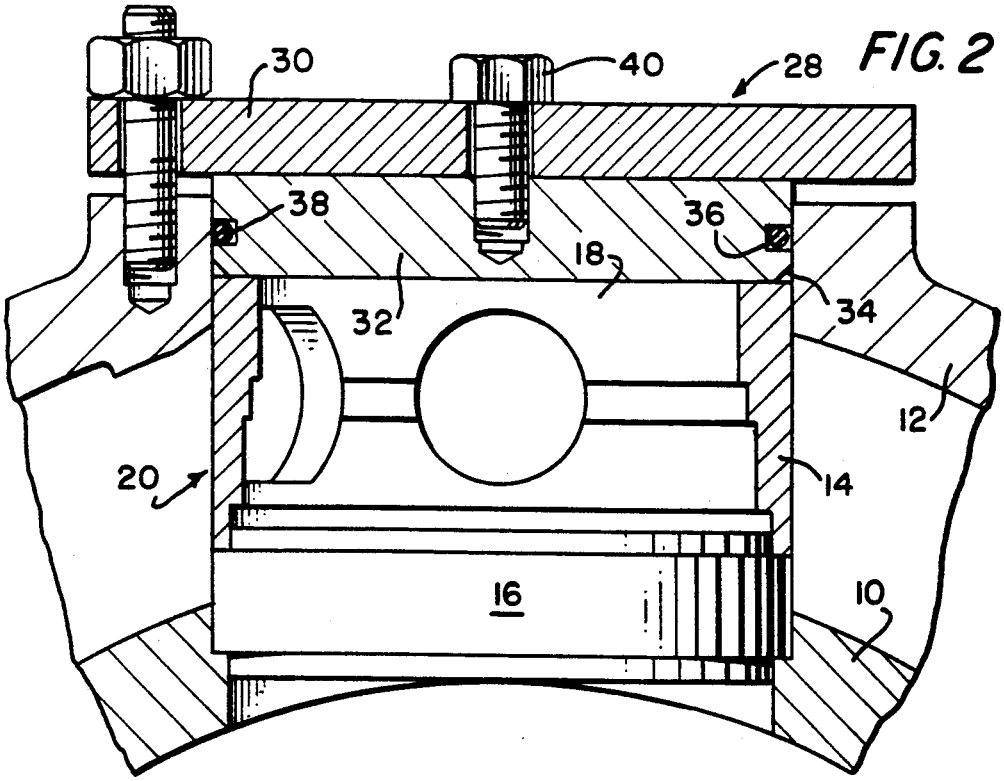
PRIOR ART FIG. 2

Further objects of this invention, as well as the novel features thereof, will become more apparent by reference to the following description, taken in conjunction with the accompanying figures, in which:

FIG. 1 is a vertical, cross-sectional view of a compressor housing showing a prior art valve cover fastened in place, in a housing shell and retaining a valve in place; and FIG. 2 is a vertical, cross-sectional view of a cover and retainer, for a valve in a compressor housing shell, according to an embodiment of the invention.

As shown in FIG. 1, a typical compressor will comprise an inner shell 10, and an outer shell 12, the two being apertured, over a compression cylinder (not shown), to receive therein a fluid valve 14. As depicted, there is the valve 16, proper, and thereabove is the valve crab 18. For the purposes of this discussion, both valve 16 and crab 18 will be considered as a single unit 20.

A domed cover 22, of cast metal, has an outwardly extending flange 24 by means of which it is held fast to the shell 12. Too, it has an inner annulus 26 which contactingly engages the valve-crab unit 20, to hold the latter in place in the shells 10 and 14.

According to my invention, the specially cast cover 22 is dispensed with and replaced with components readily available from standard stock or raw materials. As depicted in FIG. 2, the novel cover and retainer 28, comprises a cover 30 fabricated from simple, flat plate of uniform thickness. The retainer comprises a flat, solid, cylindrical plug 32. The plug 32 is of uniform thickness, save for a taper 34 on an inner edge thereof to facilitate its insertion into the outer shell 12, and a groove 36 formed therein and thereabout. An O-ring seal 38 is set within the groove 36 to fluid seal thereat between the shell 12 and the plug 32.

In the periphery of the plate cover 30 are formed bolt holes. These receive the standard cover-retaining bolts (only one of which is shown). The plug 32 is formed with a depth or thickness to insure that a portion thereof projects outwardly from the shell 12. Consequently, with the plate cover 30 fastened in place, against the plug 32, it can be assured that the plug 32 is made fast against the valve unit 20.

Optionally, the center of the plate cover 30 is bored through, to receive an assembly bolt 40, and the center of the plug bored and tapped, threadedly to receive the bolt 40. In this way, the two elements, plug 32 and plate cover 30, can be held together.

The novel cover 30 and plug 32 are readily adapted for retrofit on compressor housing shells which have the prior art type of cover 22. The requirement to make and stock such covers 22 can be dispensed with, as the novel cover 30 and plug 32 can be provided from standard stock materials. Too, where higher ratings require it, the plate material of the cover 30 can be of greater thickness, can be bored for larger cover-retaining bolts, and/or have a different bolt circle diameter. Consequently, the invention offers flexibility not found in the prior art type of cast, domes covers 22, with no loss of efficiency and performance.

While I have described my invention in connection with an embodiment thereof, it is to be clearly understood that this is done only by way of example, and not as a limitation to the scope of my invention as set forth in the objects thereof and in the appended claims.

I claim:

1. A cover and retainer, for a compressor valve in a compressor housing shell, comprising:

a plug, for (a) insertion into the shell and (b) engagement with the valve; and a cover, for wholly overlying the plug and holding the plug in place; wherein said cover comprises a simple, flat plate of uniform thickness; and said plug comprises a flat, solid, cylindrical element of substantially uniform thickness.

2. A cover and retainer, according to claim 1, wherein:

said plug has means for fluid-sealing thereabout.

3. A cover and retainer, according to claim 2, wherein:

said plug has an annular groove formed therein and thereabout; and said sealing means comprises an O-ring set in said groove.

4. A cover and retainer, according to claim 1, wherein:

said cover has means for securing thereof to the housing shell.

5. A cover and retainer, according to claim 1, further including:

means for removably fastening said plug and cover together.

6. A cover and retainer, according to claim 5, wherein:

said fastening means comprises a fastener (a) in penetration of said cover, and (b) threadedly engaged with said plug.

7. In a compressor housing shell which has a valve set therein, a cover and retainer for the valve, comprising:

a plug, within the housing shell and in engagement with the valve; and a cover, wholly overlying said plug and holding said plug in said housing shell; wherein said cover comprises a simple, flat plate of uniform thickness;

said plug comprises a flat, solid, cylindrical element of a substantially uniform thickness;

said element has an annular groove formed therein and thereabout; and further including an O-ring seal set in said groove for fluid-sealing between said element and said housing shell.

8. A cover and retainer, according to claim 7, wherein:

said plug has a portion thereof projecting from said housing shell; and said cover is spaced apart from said housing shell.

9. A cover and retainer, according to claim 7, wherein:

said cover has means for removable fastening thereof to said housing shell.

10. A cover and retainer, according to claim 7, further including:

means joining said cover and plug together into an assembled unit.

* * * * *